United States Patent [19]

Lamont et al.

[11] Patent Number: 4,676,400

[45] Date of Patent: Jun. 30, 1987

[54] LIQUID DISPENSING SYSTEM

[76] Inventors: Charles E. Lamont, 815 Strathcina St., Winnipeg, Manitoba, Canada, R3G 3G3; William A. Hansen, 95 Ashland Ave., Winnipeg, Manitoba, Canada, R3L 1K5

[21] Appl. No.: 749,292

[22] Filed: Jun. 27, 1985

[51] Int. Cl.[4] ..... B67D 5/62

[52] U.S. Cl. ..... 222/1; 222/146.6; 62/393; 62/390; 62/399

[58] Field of Search ..... 222/146.6, 146.1, 1; 141/11; 62/393, 396, 399, 390; 165/142, 155

[56] References Cited

U.S. PATENT DOCUMENTS

| | | | |
|---|---|---|---|
| 2,082,975 | 6/1937 | Riesgo | 222/146.1 X |
| 2,205,318 | 6/1940 | Sullivan | 62/399 |
| 2,248,637 | 7/1941 | McLaughlin | 62/399 X |
| 2,259,852 | 10/1941 | Hall | 62/393 X |
| 2,506,843 | 5/1950 | Seiler | 62/393 X |
| 2,598,751 | 6/1952 | Berkowitz et al. | 62/399 X |
| 2,646,667 | 7/1953 | Kromer | 62/393 X |
| 3,011,681 | 12/1961 | Kromer | 222/146.6 X |
| 3,224,641 | 12/1965 | Morgan | 222/146.6 X |
| 4,094,445 | 6/1978 | Bevan | 222/146.6 X |

*Primary Examiner*—Robert J. Spar
*Assistant Examiner*—Jay I. Alexander
*Attorney, Agent, or Firm*—Burns, Doane, Swecker & Mathis

[57] ABSTRACT

A method and apparatus for dispensing beverages permit the use of water as a coolant and utilize parasitic cooling from a walk-in cooler. At least one supply tube for a beverage leads from a container for that beverage through a cooling manifold to a dispensing tap through a conduit assembly. The conduit assembly includes a tube which enwraps one or more beverage lines and a second tube which enwraps the first tube. Coolant passes between the first tube and the beverage lines to keep the beverage lines at a desired temperature from the walk-in cooler to the remote dispensing tap. At the tap, the coolant enters a passage between the first or intermediate tube and the outer tube and returns to the walk-in cooler. In the cooler, there coolant passes through a cooling coil positioned at the discharge for the primary cooler refrigeration system. A pump in the cooler provides the necessary energy to circulate the coolant through the system.

10 Claims, 3 Drawing Figures

LIQUID DISPENSING SYSTEM

BACKGROUND AND SUMMARY OF THE INVENTION

This invention relates to a system for dispensing potable liquids, such as, for example, draft beer, and to a dispensing apparatus therefor.

The application of a dispensing device to draft beer creates a difficult problem since carbonation of beer is quite sensitive to temperature of the draft beer product. Most other carbonated beverage products can be handled by apparatus that will successfully handle draft beer. Accordingly, as draft beer is the most difficult potable beverage to handle, the application of the present invention to the draft beer product will be described as the exemplary potable beverage.

There are currently two methods of dispensing draft beer. One method involves the use of what is known as the direct-draw box. The direct-draw box, in essence, is a small refrigerator using an external forced air cooled condensing unit and an internal evaporator cooling coil with a fan. The direct-draw box includes a beer tap, usually mounted on a draft beer arm or tower, and the necessary valves and tubing required to tap the beer container or keg and to remove the beer, as well as means for pressurizing the keg with pressure regulated $CO_2$. Direct-draw boxes usually contain one keg of beer but amy even have the capacity to contain up to four kegs.

In operation, kegs are taken from refrigerated storage and placed in the direct-draw box, tapped and pressurized whereby dispensing may continue until the supply of beer within the keg is exhausted. The direct-draw box has a number of disadvantages, the principal one being the amount of space required. Typically, a minimum of five square feet is necessary. In addition, access to the box is required which can preclude the use of the box in some existing establishments. Even in newly constructed premises or those premises undergoing major renovation, it is desireable to minimize the bar area and maximize the seating area. Thus use of floor storage space for beverage storage is undesireable.

Secondly, bringing the keg, which weighs about 150 pounds, from the storage area to the draw box is a significant task. Moreover, when the keg arrives at the draw box, it usually has to be lifted about six inches form the floor to place the keg in the unit. Many establishments employ female staff, and occasionally an establishment has exclusively female staff. In such establishments, the physical demands of the direct-draw box method may also preclude its use.

In addition, there is a fairly substantial capital cost to purchase a direct-draw box unit as well as the ongoing cost of maintaining two fans, a refrigeration compressor and temperature control. Furthermore, if any of these elements should fail, or if the condenser becomes plugged, beverage sales are lost until the unit is repaired and operating again. In addition, the unit requires energy to operate and, certainly during the cooling season, heat generated by the direct-draw box unit has to be removed from the establishment by air conditioning.

The second conventional method of dispensing draft beer is by means of a remote system. This method permits an operator to dispense beer directly from a remote refrigerated storage area to the tap at the bar. Typically, the refrigerated storage area is a walk-in cooler. The remoteness between the tap and the keg can be as little as a few feet to distances of 150 feet. However, with draft beer it is important to recognize that if the beer in the lines from the walk-in cooler to the tap in the bar rises above 5 degrees Centigrade (41 degrees Fahrenheit) the beer will "break". That is, the $CO_2$ dissolved in the beer will break out and form vapor pockets in the liquid beer. When such beer arrives at the tap, it issues as pure foam. Foam will continue to be dispsensed until the beer line is re-cooled by fresh cold beer from the walk-in cooler. The amount of waste can vary from a few glasses in an installation with a short line to many gallons in an installation with a very long line. For economic reasons, it is therefore essential that the beer in the line be kept cooled to around 3 degrees C. (38 degrees F.) and it will be further recognized that with shutdowns, such as overnight, on Sundays, or holidays or combinations of any of these, maintaining the beer at 3 degrees C. cannot be done by insulation alone.

The existing method of providing remote draft beer involves running a number of tubes in parallel relationship inside a flexible foamed plastic tube which acts as an insulator. The number of tubes inside the insulating tube is generally a minimum of four—one for coolant supply, one for coolant return, and the other two available for beer. Alternatively, one of the other two may be used for beer while the other is available as a return line for cleaning the beer line. Standard commercial systems are available with up to six beer lines in addition to the two coolant lines. The known system also involves a condensing unit, a refrigerant to coolant (usually glycol) heat exchanger, a glycol sump, a glycol pump, and a glycol temperature controller.

Such a system has some advantages over the direct-draw system in that little space is required in the bar area and that kegs do not have to be transported from a storage area to the bar area. It does, however, suffer from various disadvantages. At best, the known remote system depends on line contact between the circular cooling tubes and the beer line. Thus, where a large number of beer lines are involved, some will not even have line contact. This situation will involve inefficiencies since some of the lines will have to be cooled by first having the glycol cool the air inside the insulating tube and then having the air cool the beer lines.

As with the direct-draw box there is also the relatively high capital cost of the known remote system, since it involves an additional refrigeration condensing unit. Furthermore, the cost of operating the known remote system is high since it includes its own energy cost and ongoing maintenance costs. Of course, the problems of heat removal remains and, with the additional components, the problem of ultimate failure continues. As a result of these considerations, the loss of business until repairs are effected is also a problem with the known remote system. In addition, space must be found to locate the condensing unit.

The present invention overcomes the above-mentioned disadvantages of the current methods and apparatus for dispensing draft beer by providing a dispensing system and apparatus therefor of extreme simplicity, utilizing only one moving part, i.e., the pump, which has a long record of reliable and trouble-free operation and utilizes no secondary controls.

A remote system typically involves a beverage supply which is both pressurized and pressure regulated, as well as at least one beverage tap. The present invention focuses in part on a method and apparatus for delivering beverage from a typical pressurized and pressure regulated source to a remote tap.

It is an object of the present invention to overcome the above disadvantages by providing a simple and relatively inexpensive system for dispensing beverages and a dispensing apparatus which incorporates a much more efficient heat transfer design.

According to one broad aspect, therefore, the present invention relates to a system for dispensing beverages including, in combination, (a) at least one beverage supply tube connected to a pressurized source of supply for the beverage; (b) cooling means connected to a pump which, in turn, is connected to a cooling manifold, the supply tube passing through the manifold to a dispensing tap; (c) a pair of coolant supply and return tubes substantially concentrically disposed within one another and each having one end located within the manifold and the remaining end located adjacent the tap, the supply tube passing through the coolant supply tube and being connected to the tap; and (d) a pair of inlet and outlet ports in the manifold connected, respectively, to the coolant supply and return tubes as well as to the pump and the cooling means.

According to another broad aspect, the present invention relates to apparatus for dispensing beverages, including, in combination, (a) at least one beverage supply tube connected to a pressurized source of supply of the beverage; (b) cooling means; (c) a pump connected to the cooling means; (d) a cooling manifold connected to the pump; (e) a dispensing tap, the supply tube passing through the manifold to the tap; (f) a pair of coolant supply and return tubes substantially concentrically disposed within one another each having one end located within the manifold and the remaining end located adjacent the tap, the supply tube passing through coolant supply tube and being connected to tap; and (g) a pair of inlet and outlet ports in the manifold connected, respectively, to the coolant supply and return tubes and to the pump and the cooling means.

BRIEF DESCRIPTION OF THE DRAWINGS

The above objects as well as many other objects and advantages will be apparent to those skilled in the art when this specification is read in conjunction with the drawings wherein like reference numerals have been applied to like elements, wherein the invention is illustrated by way of an example, and wherein.

DESCRIPTION OF THE PREFERRED EMBODIMENT

Figure 1:
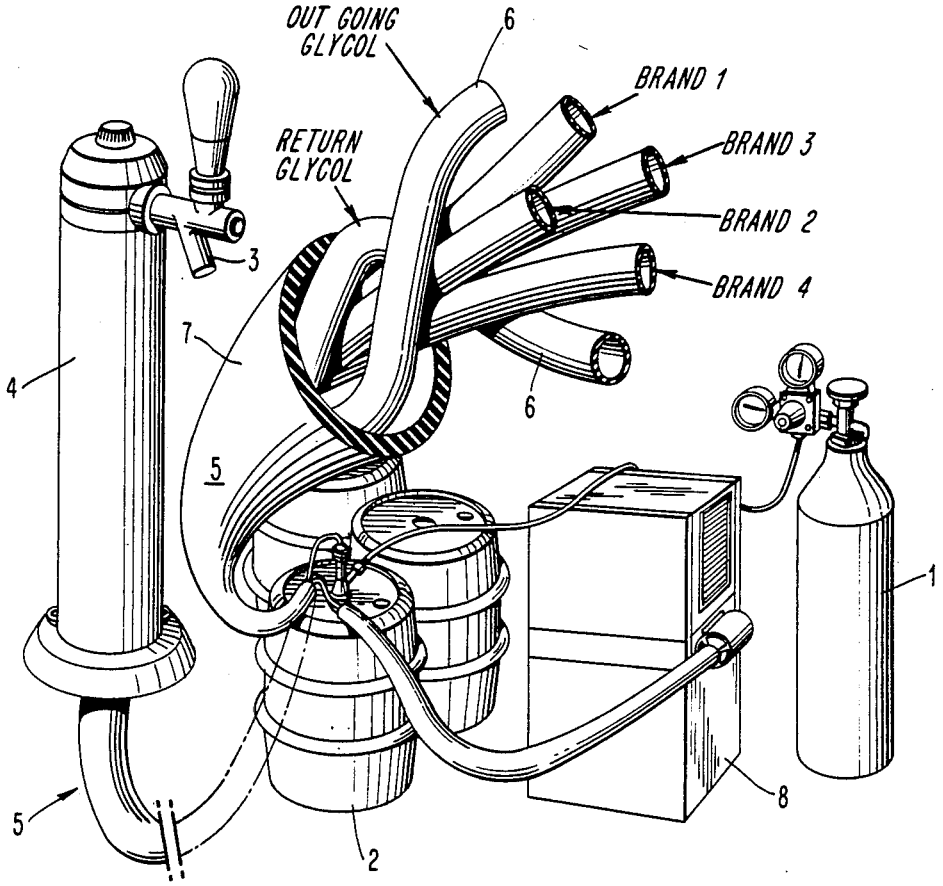
Fig. 1 PRIOR ART
FIG. 1 is a diagrammatic sketch of one type of prior art beer dispensing apparatus.

Referring to the drawings, and in particular to FIG. 1, the prior art beer dispensing apparatus shown therein basically consists of a cylinder 1 of $CO_2$, provided with the usual pressure gauges and pressure regulating valve, connected to one or more beer kegs 2 for pressurization of the contents to force the beer to a dispensing tap 3 disposed on a dispensing tower 4. A "refrigerated" trunk line, indicated generally at 5, is provided for conveying the pressurized beer from the keg or kegs 2 to the tower 4. This trunk line 5 consists, for example, of several beer lines for different brands of beer (each connected to its own keg 2) and two outgoing and return coolant lines 6 entwined therearound and surrounded by a flexible outer insulated covering 7. The coolant lines 6, containing glycol, are connected to a refrigeration unit 8.

In operation of this prior art device, beer from the kegs flows through the beer lines in the "refrigerated" trunk line 5 to the tap 3. Outgoing glycol from the refrigeration unit 8, flows through the outgoing glycol line 6 to the draft beer arm 4. At the draft beer arm 4, the outgoing glycol line 6 is connected to a soft copper tube loop (not shown). The other end of said copper tube is connected to the return glycol line 6 through which the glycol returns to the refrigeration unit 8 for re-cooling. Line and/or point surface contact between the coolant lines and the beer lines will be clearly apparent from this FIG. 1.

Figures 2, 3:
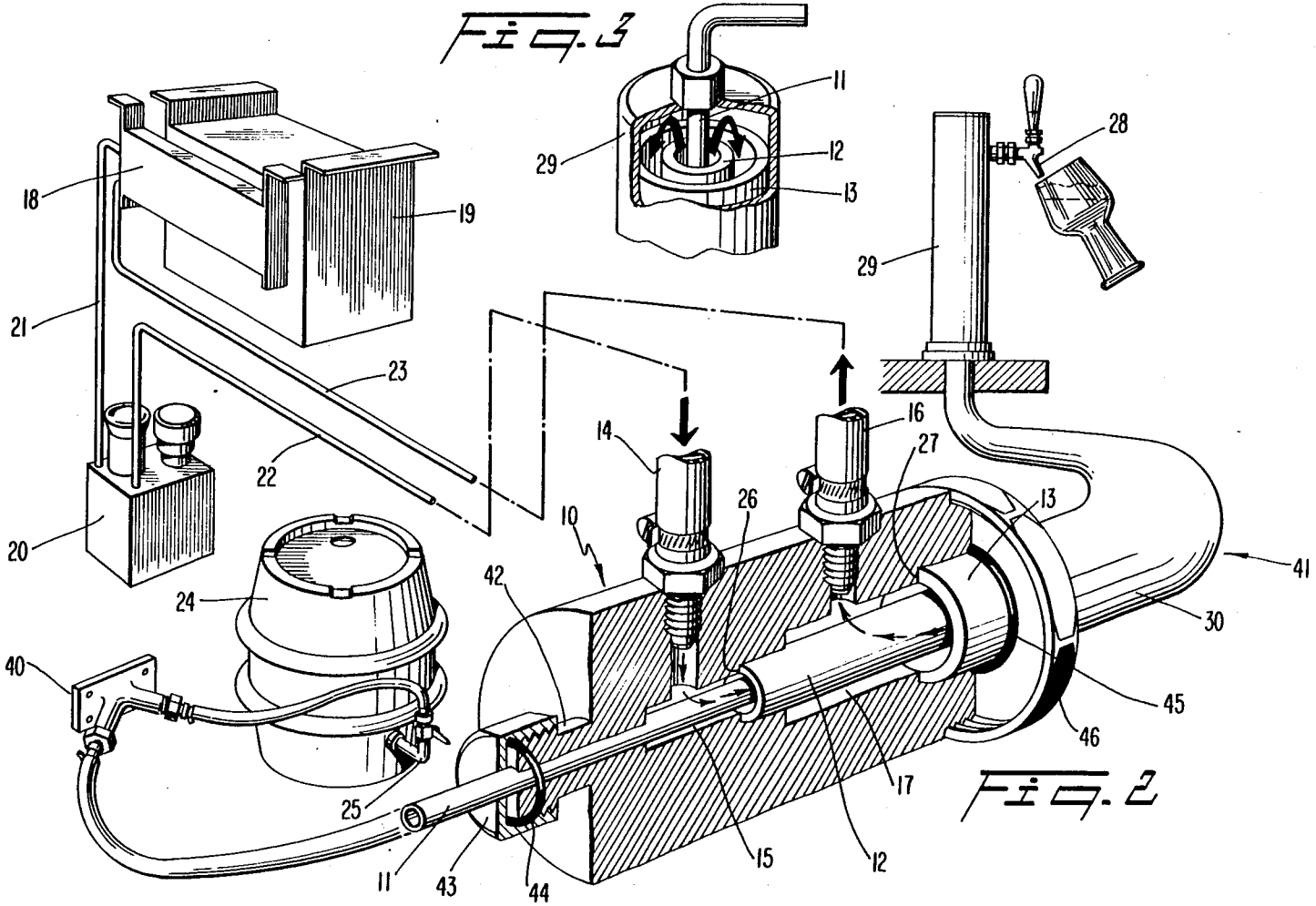
FIG. 2 is a diagrammatic sketch of the apparatus of the present invention.
FIG. 3 is a detail view of a portion of the apparatus shown in FIG. 2.

Referring now to FIG. 2, the apparatus for dispensing beverages such as, for example, draft beer, soft drinks (premixed as well as postmixed syrups) regular and diet types, mineral water, natural water, milk, etc. of the present invention is schematically illustrated. A keg 24 of beer is located in a refrigerated storage space such as a walk-in cooler. The keg 24 of beer is connected, in known manner, to any suitable source of $CO_2$, or compressed air via a suitable connection 25 located at its lower end. A beer line extends from the connection 25 to an angle wall bracket to V-coupling 40, which may be attached to an interior wall of the walk-in cooler. This V-coupling 40 is essentially a short conduit which has two ends and which can be attached to a surface. One end of the coupling conduit is attachable to the beer line from the keg; the other end of the coupling conduit is attachable to a tube 11 which ultimately delivers the beverages to a remote tap 28. The V-coupling 40 provides a convenient means for attaching the beverage tube 11 to a beverage source since the line from a keg being used can easily connected to the coupling. Moreover, the beverage source being used can be changed by merely attaching a line from a different beverage source to the coupling 40 without physically moving heavy beverage sources themselves.

Also positioned in the walk-in cooler is a supply manifold 10 which is preferably mounted on an interior wall of the cooler and is connected with one end of a flexible conduit assembly 41 which itself includes at least three tubes: i.e., at least one inner tube, for example, a draft beer tube 11, surrounded by an intermediate or coolant supply tube 12 which, in turn, is surrounded by an outer or coolant return tube 13. These tubes are arranged such that a first intermediate space (which may be generally annular when a single inner tube 11 is used) is defined between the inner tube 11 and the intermediate tube 12 and such that a second intermediate space (which may be generally annular) is defined between the intermediate tube 12 and the outer tube 13. The intermediate tube 12 and the outer tube 13 may be generally concentric.

The manifold means 10 is operable to supply coolant to the first intermediate space and to receive coolant from the second intermediate space of the conduit assembly. The manifold may be fabricated from a suitable metal or plastic material and may be generally cylindrical. Extending through the manifold 10 in an axial direction is a bore which receives the innermost tube 11 of the conduit assembly. As will be seen FIG. 2, the innermost tube 11 may extend completely through the manifold 10 so that it projects from one end. The end of the innermost tube 11 which extends from the manifold 10 is ultimately connected with a coupling 40 that can be mounted on a wall. Where two or more beer lines are to be used, each may be provided with a corresponding coupling. In addition, where two or more beer lines are used, each line will pass through the manifold 10 at a centrally disposed location and the intermediate tube 12 will surround all of the centrally located beer lines 11.

On one side of the manifold 10, a radially extending coolant inlet port 14 is provided which leads to a first inner chamber 15 that surrounds the innermost tube 11. The same side of the manifold 10 is also provided with a radially extending coolant outlet port 16 leading to a second inner chamber 17. The outlet port 16 is preferably positioned between the inlet port 14 and the end of the manifold 10 attached to the conduit assembly. In this manner, the returning coolant will be positioned on the outside of the conduit assembly at the most distant position from the beer line 11.

The second inner chamber has a slightly greater diameter than first inner chamber 15. It will also be noted from FIG. 2 that the chambers 15 and 17 are radially "stepped" as at 26, 27. With this arrangement, each radial land or step 26, 27 serves as an abutment for the corresponding inner ends of, respectively, the coolant supply tube 12 and the coolant return tube 13. In addition, the "step" 26 serves to isolate the supply and return coolant tubes. Since minor leakage at this "step" 26 does not affect the overall performance of the apparatus, no specific seal is necessary and none is provided.

That end of the manifold 10 from which the beverage line 11 projects may be provided with a threaded extension 42 fitted with an internally threaded cap 43. A conventional O-ring seal 44 may be provided between the cap 43 and the extension 42 to prevent leakage of coolant from the end of the manifold. In the arrangement illustrated, the cap 43 also includes an orifice through which the beverage tube 11 projects. That orifice is sized so that coolant will not leak therefrom. If desired, the O-ring seal could be placed where the beverage tube 11 enters the manifold 10 so that when the cap 43 is tightened the seal simultaneously seals the coolant from escaping between the cap 43 and the tube 11 and from escaping between the cap 43 and the extension 42. Alternately, the end of the manifold 10, may simply be provided with a bore to receive the beverage tube 11, and a counter bore (not shown) to receive a suitable fluid seal such as an "O" ring.

At the other end of the manifold 10, another internally threaded cap 45 is provided which is fastened to a correspondingly threaded portion of the manifold 10. An O-ring seal 46 is provided at the location where the outer tube 13 of the conduit assembly 41 enters the manifold. Accordingly, when the cap 45 is tightened, the conduit assembly 41 is sealed to the manifold so that coolant does not leak between the cap and the manifold and so that coolant does not leak between the cap and the outer tube 13 of the conduit assembly.

That portion of the conduit assembly between the manifold 10 and a beer dispensing tap 28 (forming part of a beer dispensing tower 29) is covered with an armaflex sleeve 30 or any other suitable conventional insulating, flexible, foam, protective covering. The conduit assembly passes through the wall of the walk-in cooler and extends from the manifold 10 to the tower 29. With the construction of the conduit assembly, heat loss radially from the outer tube 13 of the conduit assembly is reduced and heat transfer radially to the conduit assembly from the environment is likewise reduced.

The beer dispensing tap assembly includes a tower 29 and a tap 28. The tower 29 is located at one end of the conduit assembly and includes a means for establishing fluid communication between the first and second intermediate spaces of the conduit assembly. More specifically, a header manifold (see FIG. 3) allows coolant supplied to the intermediate space between the inner tube 11 and the intermediate tube 12 to enter the generally annular space between the outer, coolant return tube 13 and the intermediate tube 12. The header manifold also permits the inner tube 11 to communicate with the tap 29 so that beer in the inner tube 11 can be dispensed from the tap 29.

The tap 28 itself is a suitable conventional device which can be obtained from any one of several supply sources.

Coolant circulated through the conduit assembly is contained in a closed loop or system which includes the conduit assembly, a cooling coil 18, a pump 20 and related conduits. The cooling coil 18 is finned secondary cooling coil 18 mounted immediately adjacent to an existing on-site primary cooling unit 19. That primary cooling unit 19 is part of the refrigerated storage space and thus is an extant device. The cooling coil means 18 is the sole means provided for maintaining temperature of coolant in the closed system at a predetermined temperature.

The secondary cooling coil is located on the air-discharge side of the one-site cooling unit 19 on the inside of the walk-in cooler. A discharge line 21 connects the cooling coil 18 to a coolant sump and pump 20 which may be mounted on the wall of the walk-in cooler. The sump and pump 20 is connected to the inlet port 14 of the manifold 10 by means of a second line 22. The outlet port 16 of the manifold 10 is connected to the finned cooling coil 18 (for a return flow of coolant) by means of a third or return line 23. Preferably the coolant used in the closed system is water.

It will also be noted that all of the equipment is located within the existing refrigerated walk-in cooler with the exception of a portion of the insulated conduit assembly and the return header, which of course, is located at the dispensing point.

By locating the secondary cooling coil 18 immediately in front of the discharge side of the existing on-site cooling unit 19, the cooling means in effect becomes a form of "parasitic" cooling means. More particularly, there is no separate, self-contained cooling system used with the beverage supply system. On the contrary, the cooling coil 18 for the beverage supply system relies for its cooling source entirely on the primary on-site cooling unit 19 that is provided to keep the walk-in cooler at the proper temperature. With this arrangement, the beverage supply system eliminates the expense of a compressor unit, eliminates the heat load in the walk-in cooler that a compressor unit would cause, and permits the use of very inexpensive liquids, such as water, as the fluid coolant, while only imposing a heat load on the refrigeration system for the walk-in cooler that corresponds to the heat rejected by the pump and heat rejected from keeping the beer line cold.

Insofar as walk-in coolers are concerned, they are typically provided with a cooling device which is usually an evaporator-coil cooling unit 19 having a fan (not shown) to move air over the coil of the cooling unit 19 and into the cooler-space so as to maintain the latter in a properly predetermined cooled condition. By positioning the finned secondary cooling coil 18 directly adjacent to, and in front of air being discharged from the walk-in cooler's existing evaporator coil 19, the position ensures that the secondary coil 18 will never be subjected to air warmer than ambient temperature in the walk-in cooler and when the primary refrigerating unit is operating, the secondary coil 18 will be subjected to air five to eight degrees Centrigade lower than the average space temperature in the walk-in cooler.

In addition, the coolant returning from the conduit assembly represents the coolant at its warmest temperature. This warm coolant is sent directly to the cooling coil 18 where it will encounter the coldest air in the cooler through a heat exchange relationship thereby ensuring excellent heat transfer due to existence of the widest possible temperature difference. It will also be understood by those knowledgeable in the art that secondary cooling coil 18 is selected to ensure the maximum possible efficiency of heat transfer without in any major way interfering with or blocking the normal air flow within the walk-in cooler. After heat is removed from the coolant by air from the primary coil 19, the coolant is returned to the sump for recirculation by the pump 20. From the pump 20, the coolant is delivered to the manifold 10 where it enters the annular space surrounding the inner tube 11. As the coolant passes along the conduit assembly, the coolant maintains beverage in the inner tube 11 at the temperature of the walk-in cooler. When the coolant reaches the tower 29, the coolant passes to the annular space between the outer tube 13 and the intermediate tube 12 and returns to the manifold 10 in the walk-in cooler.

In this manner the present invention ensures that the beverage is delivered to the point of dispensing at a temperature suitable for serving customers and, particularly with draft beer, in a temperature condition which will eliminate wastage due to excessive foaming.

The present system will be appreciated even by those not skilled in design, as a superior system due to its simplicity in not requiring an additional refrigeration unit, and not requiring any controls other than a pump switch. Also all the components within the walk-in cooler can be located where they will not detract from utilization of storage space, e.g., the secondary coil placed in front of the existing cooling coil occupies space that must be left clear of any stored product to allow air circulation; the sump and pump can be located high up on the wall where product is not stored; the supply manifold can be located anywhere, occupying a wall space of about two inches by six inches, on a wall or the ceiling at a place most convenient and inconspicuous to allow the shortest possible run of concentric tubing lines.

Those skilled in the art of heat transfer will appreciate that the piping arrangement allows the warmest coolant meeting the coldest air to achieve the maximum temperature difference and will also appreciate the fact that with cooling channels completely enwrapping the beverage lines, environmental heat from the areas through which the conduit assembly travels must first get through the insulation sleeve 30 surrounding the conduit assembly; then through the plastic material wall of the return coolant tubing 13; then through the returning water coolant; then through the plastic material wall of the coolant supply tubing 12; and then through the supply coolant; before any heat can even arrive at the tubing 11 containing the beverage. In practice, heat coming through the insulation 30 is picked up by the return coolant and does not arrive at the product.

It will now be apparent that a beverage dispensing system and method of operation have been disclosed which overcome problems of the type discussed above. Moreover, it will be apparent to those skilled in the art that numerous modifications, variations, substitutions, and equivalents exist for various features of the invention which do not materially depart from the spirit and scope of the invention. Accordingly, it is expressly intended that all such modifications, variations, substitutions, and equivalents that fall within the spirit and scope of the invention as defined in the appended claims be embraced thereby.

What is claimed is:

1. Apparatus for dispensing a beverage stored in a walk-in cooler at a location remote from that cooler comprising:

a conduit assembly including at least one beverage tube surrounded by an intermediate tube such that a first intermediate space is defined therebetween, and an outer tube surrounding the intermediate tube such that a second intermediate space is defined therebetween, the assembly having a pair of ends;

manifold means for supplying coolant to the first intermediate space and for receiving coolant from the second intermediate space of the conduit assembly, connected to one end of the conduit assembly such that the at least one beverage tube of the conduit assembly passes therethrough;

means attached to the at least one beverage tube of the conduit assembly for connecting the at least one beverage tube to a beverage source;

a dispensing tap connected to the second end of the conduit assembly, including means for establishing fluid communication between the first and second intermediate spaces; and parasitic cooling means for providing a chilled liquid coolant to the manifold means, operable solely with an exisiting refrigeration means for cooling said walk-in cooler, the parasitic cooling means being a closed loop including pump means for circulating liquid coolant to the manifold means, and cooling coil means connectable between the pump means and the manifold means, for maintaining temperature of liquid coolant received from the manifold means at a predetermined level and operable to be cooled by the existng refrigeration means.

2. The apparatus of claim 1 wherein the conduit assembly also includes a sleeve of thermal insulation surrounding the outer tube.

3. The apparatus of claim 1 wherein the intermediate tube and the outer tube are generally concentric.

4. The apparatus of claim 3 wherein the at least one beverage tube is generally concentric with the intermediate tube so that coolant can surround the at least one beverage tube.

5. The apparatus of claim 1 wherein the manifold means includes an inlet port for connection with the pump means and an outlet port for connection with the cooling coil means.

6. A system for dispensing beverages comprising:

a pressurized beverage source;

a cooling manifold;

a tap;

at least one beverage supply tube connected to the beverage source, passing through the cooling manifold to the tap;

parasitic cooling means for providing a chilled liquid coolant to the cooling manifold, operable solely in conjunction with an existing refrigeration system for cooling said beverage source, the parasitic cooling means being a closed loop including a pump connected to the cooling manifold, cooling means connected to the pump and operable to be cooled by the existing refrigeration system;

a coolant supply tube and a return tube substantially concentrically disposed within one another and each having one end located within the manifold and the remaining end located adjacent the tap, the beverage supply tube passing substantially concentrically through the coolant supply tube and being connected to the tap; and a pair of inlet and outlet ports in the manifold connected, respectively, to the coolant supply tube and the return tube as well as to the pump and the cooling means.

7. An apparatus for dispensing beverages comprising:

at least one beverage supply tube connected to a pressurized source of beverage supply;

parasitic cooling means for providing a chilled liquid coolant, operable solely in conjunction with an existing refrigeration system for cooling said beverage supply, the parasitic cooling means being a closed loop including a pump connected to the cooling means, a cooling manifold connected to the pump and positioned so as to be cooled by the existing refrigeration system;

a dispensing tap, the beverage supply tube passing through the manifold to the tap;

a coolant supply tube and a return tube substantially concentrically disposed within one another each having one end located within the manifold and the remaining end located adjacent the tap, the beverage supply tube passing through the coolant supply tube and being connected to the tap; and a pair of inlet and outlet ports in the manifold connected, respectively, to the coolant supply tube and the return tube as well as to the pump and the cooling means.

8. A remote dispensing system for beverages comprising:

a cooler having a refrigeration system including a primary cooling coil through which air in the cooler is circulated;

a pressurized beverage source located in the cooler;

a conduit assembly including at least one beverage tube surrounded by an intermediate tube such that a first generally annular space is defined therebetween, and an outer tube surrounding the intermediate tube such that a second generally annular space is defined therebetween, the assembly having a pair of ends, the assembly extending from the beverage supply to a location remote from the cooler;

a tap assembly positioned at the remote location, connected to the second end of the conduit assembly, including means for establishing fluid communication between the first and second generally annular spaces;

manifold means for supplying coolant to the first and generally annular space and for receiving coolant from the second generally annular space of the conduit assembly, connected to one end of the conduit assembly such that the at least one beverage tube of the conduit assembly passes therethrough;

means attached to the at least one beverage tube of the conduit assembly for connecting the at least one beverage tube to the beverage source; and parasitic cooling means for supplying a chilled liquid coolant to the manifold means, operable solely in conjunction with said refrigeration system, the parasitic cooling means including pump means for circulating coolant to the manifold means and cooling coil means connectable between the pump means and the manifold means, positioned at the discharge of the primary cooling coil, for maintaining temperature of coolant received from the manifold means at a predetermined level.

9. The system of claim 8 wherein the coolant is water.

10. A method of remotely dispensing a beverage comprising the steps of:

connecting a beverage tube between a beverage source in a cooler having an existing refrigeration system for cooling said beverage source and a remote dispensing tap;

surrounding the beverage tube with a coolant supply tube such that a first space is defined therebetween;

surrounding the coolant supply tube with a coolant return tube such that a second space is defined therebetween;

establishing fluid communication between the first space and the second space at the tap;

circulating a cooling liquid from a location within the cooler through the first space to the tap and back through the second space to the cooler in a closed loop; and parasitically cooling the liquid returning from the second space by passing the liquid in heat exchange relationship with air in the cooler which has been chilled by the existing refrigeration system.

* * * * *